United States Patent [19]

Neubert et al.

[11] 3,981,133

[45] Sept. 21, 1976

[54] OPEN-END SPINNING UNIT

[75] Inventors: Rolf Neubert, Schwanewede; Harm Schiebenhöfer; Rolf Wehling, both of Bremen, all of Germany

[73] Assignee: Fried. Krupp Gesellschaft mit beschrankter Haftung, Essen, Germany

[22] Filed: Sept. 23, 1975

[21] Appl. No.: 616,038

[30] Foreign Application Priority Data

Oct. 4, 1974 Germany ..... 2447339

[52] U.S. Cl. ..... 57/58.95; 57/58.91

[51] Int. Cl.[2] ..... D01H 1/12

[58] Field of Search ..... 57/58.89, 58.91, 58.93, 57/58.95, 50; 19/105

[56] References Cited

UNITED STATES PATENTS

| | | | |
|---|---|---|---|
| 3,732,681 | 5/1973 | Kutscher et al. | 57/58.95 |
| 3,757,506 | 9/1973 | Kutscher et al. | 57/58.95 |
| 3,774,386 | 11/1973 | Kutscher et al. | 57/58.95 |
| 3,864,902 | 2/1975 | Wehling et al. | 57/58.95 |
| 3,875,733 | 4/1975 | Wehling | 57/58.95 |
| 3,882,666 | 5/1975 | Muller | 57/58.95 X |

*Primary Examiner*—John Petrakes
*Attorney, Agent, or Firm*—Spencer & Kaye

[57] ABSTRACT

In an open-end spinning unit having a spinning rotor presenting an entrance opening, a break-up roller mounted for rotation coaxially with the spinning rotor and having a frontal end section at the end thereof directed toward the spinning rotor, the frontal end section being generally enclosed by the portion of the spinning rotor defining its entrance opening, and a housing enclosing at least part of the break-up roller, there is further provided, in order to improve the guidance of fibers into the fiber collecting trough of the spinning rotor, a fiber collecting ring located between, and coaxial with, the spinning rotor and the break-up roller, and supported by the housing, the fiber collecting ring protruding axially, in the direction away from the spinning rotor, beyond the frontal end section of the break-up roller and, in the direction toward the spinning rotor, beyond the entrance opening of the spinning rotor, with the inner surface of the fiber collecting ring facing the break-up roller and serving at least partially as a fiber guiding surface.

19 Claims, 10 Drawing Figures

OPEN-END SPINNING UNIT

BACKGROUND OF THE INVENTION

The present invention relates to an open-end spinning unit of the type having a break-up roller arranged to be coaxial with the spinning rotor. This break-up roller receives rovings from a feed roller and breaks the rovings up into individual fibers, the feed roller being immediately ahead of the break-up roller or being connected thereto through the intermediary of a feed channel.

In open-end spinning units having break-up rollers which are arranged to be coaxial with the spinning rotor, the individual fibers are known to be fed into the spinning rotor in the form of a bell-shaped veil. The fibers thus enter over the entire periphery of the spinning rotor, i.e. during the yarn formation process newly fed-in individual fibers are continuously added to the yarn and are bound into it to a greater or lesser degree in dependence on the time of the yarn formation. Consequently, certain properties of the yarn being formed vary in a periodic manner, this being true, in particular, of its roughness.

The problems of adding individual fibers into the spinning rotor have already been discussed in German Auslegeschrift [Published Patent Application] No. 1,111,549. The spinning unit disclosed in this publication is provided with a stationary fiber guide disc disposed in front of the spinning rotor. A narrow space is provided between the surface of the fiber guide disc and the inner bottom surface of the spinning rotor and the yarn formed in the fiber collecting trough of the spinning rotor is guided through this space. The fiber guide disc thus produces sufficient separation between the fibers shooting into the fiber collecting trough and the yarn extracted therefrom.

German Offenlegungsschrift [Laid-Open Application] No. 2,064,697 further discloses an open-end spinning unit having a break-up roller which is arranged to be coaxial with the spinning rotor and which is also provided with a fiber guiding service. This device presents a substantially radial annular gap which is formed, on the one hand, by a fiber guide edge provided at the break-up roller and, on the other hand, by the suitably designed housing edge of the break-up roller housing.

SUMMARY OF THE INVENTION

It is an object of the present invention to provide an open-end spinning unit having a break-up roller which is arranged to be coaxial with the spinning rotor and which provides improved fiber guidance compared to the known spinning units while preventing the formation of yarn having periodically changing properties.

This, and other objects according to the invention are accomplished by the provision of a fiber collecting ring between the spinning rotor and the break-up roller, the fiber collecting ring being coaxial with both the spinning rotor and the break-up roller and being supported at the stationary enclosure which at least partially encloses the break-up roller. The fiber collecting ring, when viewed in an axial plane, protrudes toward the rear over the frontal end section of the break-up roller as well as toward the front over the entrance opening of the spinning rotor. In addition, the inner surface of the collecting ring which faces the surface of the break-up roller serves at least in part as a fiber guiding surface.

In contradistinction of the earlier-described known spinning units, the individual fibers leaving the break-up roller enter the spinning rotor or the intake region of the spinning rotor, respectively, exclusively via the inner surface of the fiber collecting ring. The inner surface of the fiber collecting ring, which guides the individual fibers, is advantageously made of a material having a coefficient of friction which is adapted to the fiber material being processed and produces a braking effect on the fibers and thus a concentration of the fibers in a certain region. Since, consequently, the fibers leave the fiber collecting ring with only a relatively small angular speed, fibers which are not sufficiently bound into the yarn being formed are placed thereagainst only to a lesser extent. This improves the yarn eveness. The angle, which defines fiber-spread, extends around a certain portion of the periphery of the collecting ring.

In order to be able to advantageously influence conditions in the area where the fibers enter into the spinning rotor, the fiber collecting ring is made displaceable in the axial direction with respect to its supporting stationary enclosure. The end section of the fiber collecting ring which faces the spinning rotor is thus able to take on different positions, for example with respect to the fiber collecting trough of the spinning rotor.

In one embodiment of the present invention, the frontal end section of the fiber collecting ring, which is arranged to be rotatable with respect to the stationary enclosure, is provided with a fiber discharge opening. The fiber discharge opening, which may have various shapes and sizes depending on the type of fiber material to be processed, influences the area through which the individual fibers enter into the spinning rotor. By rotating the fiber collecting ring, the position of the fiber discharge opening with respect to the point of fiber feed-in can be adjusted in a manner which is suitably adapted to the particular process.

In a preferred embodiment of the present invention, the fiber collecting ring is constituted by a plurality of concentric tubular components which are movable with respect to one another, each component being provided with an opening.

By displacing the tubular components with respect to one another, the effective size of the fiber discharge opening of the fiber collecting ring can be varied as desired.

Since the friction conditions in the area of the fiber collecting ring depend substantially on the existing speed conditions, a further embodiment of the present invention provides for driving the fiber collecting ring, which in this case is connected with the stationary enclosure by means of a bearing device. The fiber collecting ring may then be connected with a drive means, for example through the intermediary of a drive belt, so that it is possible to impart certain peripheral speeds to the fiber collecting ring to correspond to the given requirements. In a particularly preferred embodiment of the drive means, the fiber collecting ring is provided with an axially polarized multipole annular magnet which is spaced from, and opposite to, an annular surface presented by a body of electrically conductive material fastened to the spinning rotor.

Due to the relative movement between the annular magnet and the annular surface of electrically conductive material, eddy currents are produced in the body of electrically conductive material and thus a force is generated which carries along the fiber collecting ring which itself is not provided with any direct drive. The magnitude of the alternating magnetic effect, and thus the rate of rotation of the fiber collecting ring can be varied by changing the axial distance between the annular magnet and the annular surface, i.e. by axially displacing the annular surface with respect to the fiber collecting ring.

In a further preferred embodiment of the present invention, the opening in the fiber collecting ring, which is defined by its inner surface, widens, in a cross-sectional plane containing the ring axis, in the region of the frontal end section in the direction toward the spinning rotor, the widening being along either a straight or a curved line.

Further significant features of the present invention will be explained below with respect to several embodiments which are illustrated in the drawings.

DESCRIPTION OF THE PREFERRED EMBODIMENTS

Figure 1:
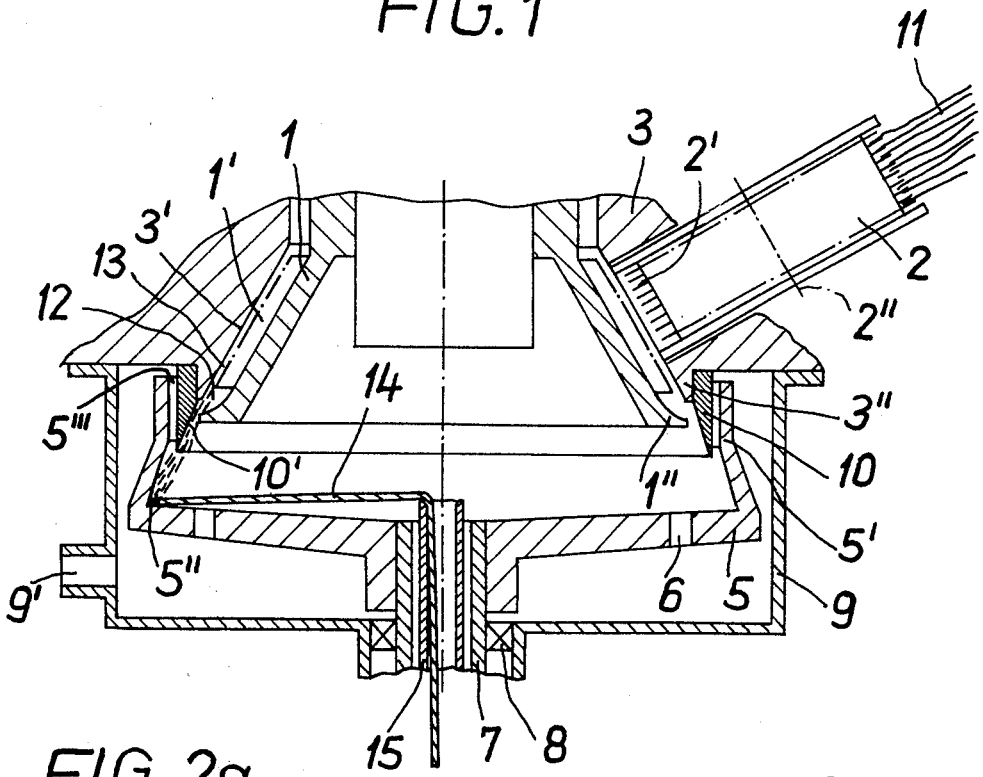
FIG. 1 is a simplified, longitudinal cross-sectional view of an open-end spinning unit having, according to the present invention, a fiber collecting ring which is supported at the break-up roller housing.

The open-end spinning unit illustrated in FIG. 1 essentially includes a conical break-up roller 1 which is provided with combing members 1' and is associated with a feed roller 2 carrying feed members 2'. The two rollers 1 and 2 are disposed in a break-up roller housing 3 whose conical interior wall 3' partially encloses the break-up roller 1. The feed roller 2 is arranged so that its axis of rotation 2'' is disposed at least approximately parallel to the linear generatrix of the plane defined by the tips of the combing members 1' adjacent roller 2.

The break-up roller 1 is arranged to be coaxial with a spinning rotor 5 which is provided with bores 6 and which is supported, via a hollow shaft 7 and bearings 8, in a housing 9 whose interior is maintained under a subatmospheric pressure and which is tightly connected in a hermetically sealed manner with the break-up roller housing 3.

The interior of housing 9 is connected, via an opening 9', with a suction pressure generating system (not shown). In the region of the outwardly curved frontal end section 1'' of the break-up roller 1, a fiber collecting ring 10 is mounted on housing 3, being supported by a protrusion 3'' of housing 3. The fiber collecting ring 10 is arranged to be coaxial with break-up roller 1 and spinning rotor 5 and extends into the space between the end section 1'' and the inlet section 5' of the spinning rotor 5. Inlet section 5' defines a rotor clearance 5'''. The inner surface 10' of the fiber collecting ring 10 defines an opening which widens linearly in the direction toward the spinning rotor 5. In the illustrated embodiment, the fiber collecting ring is arranged to be stationary on housing 3. It is, however, also possible to arrange the fiber collecting ring to be rotatable so that it can be fastened in various angular positions on housing 3.

During operation, rovings 11 are introduced by means of feed roller 2 and are fed directly to break-up roller 3 whose combing members 1' break them up into individual fibers 12. As a result of centrifugal force and subatmospheric pressure, these individual fibers pass through gap 13 adjacent combing members 1' and reach the inner surface 10' of the fiber collecting ring 10 from where they pass to the fiber collecting trough 5'' of the spinning rotor 5. From there the individual fibers are extracted continuously as finished yarn 14 through a delivery nozzle 15 disposed within hollow shaft 7.

In FIG. 1, the drive components for rotor 5 and rollers 1 and 2 are omitted for the sake of simplicity.

Figure 2A:
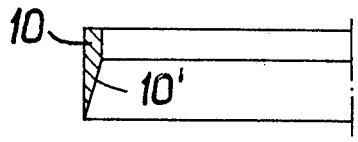
FIGS. 2*a*, 2*b*, 2*c* and 2*d* are cross-sectional detail views of different embodiments of fiber collecting rings according to the invention having different cross sections in the area of their frontal end region.
Figure 2B:
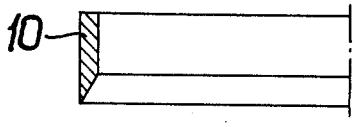
Figure 2C:
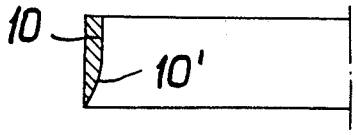
Figure 2D:
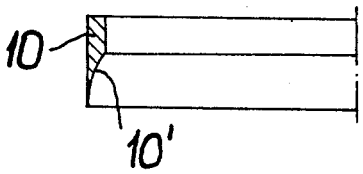

The fiber collecting ring 10 may be designed differently in dependence on the type of fiber material to be processed and on the speed conditions involved, four different forms of construction being shown in FIGS. 2*a* through 2*d*. The opening in the fiber collecting ring 10, which is defined by inner surface 10', may be designed so that a cone with different pitch angle from the remainder of the ring is produced in the region of the frontal end section through which the fibers are guided, as is shown in FIGS. 2*a* and 2*b*. The inner surface 10' may also be convex or concave as shown in FIGS. 2*c* and 2*d*, respectively, so that the opening of the fiber collecting ring defined by inner surface 10' is enlarged in a curved manner in the direction toward the spinning rotor.

In a modification of the illustrated embodiments of the fiber collecting ring 10, its outer profile may have the shape of a cone or it may be curved in a manner to be adapted to the cross section of the spinning rotor.

The inner surface 10' is preferably given properties, for example roughness values, which are adapted to the fiber material to be processed. For example, the inner surface 10' may be provided with a coating applied to the body of the fiber collecting ring. As coating can be used aluminum-oxide, polytetrafluorethylene or chromium. The roughness can for example be 3 micrometers for 15 dtex fibers and less than 1 micrometer for 1.5 dtex fibers.

Figure 3A:
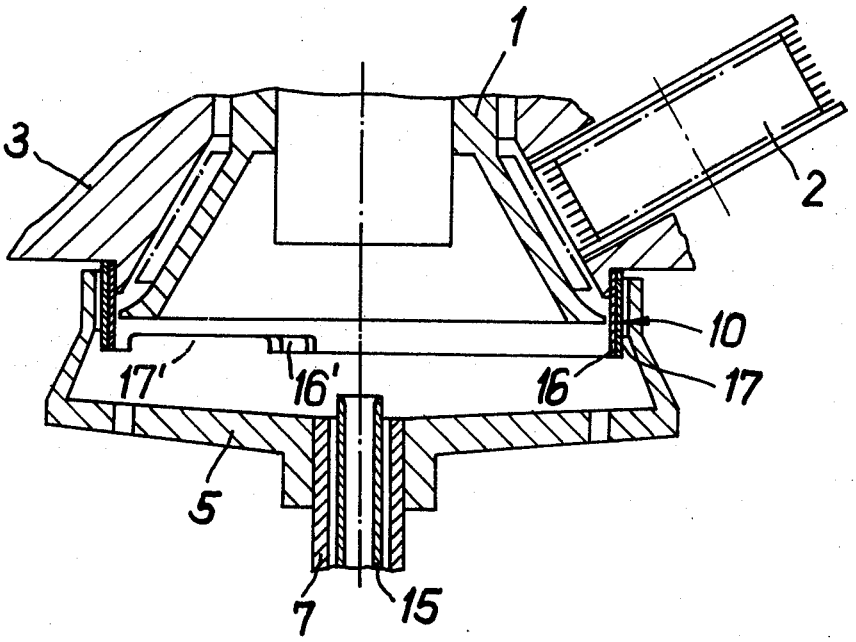
FIG. 3*a* is a view similar to that of FIG. 1 of another embodiment of an open-end spinning unit which is provided according to the invention with a multiple-part fiber collecting ring.
Figure 3B:
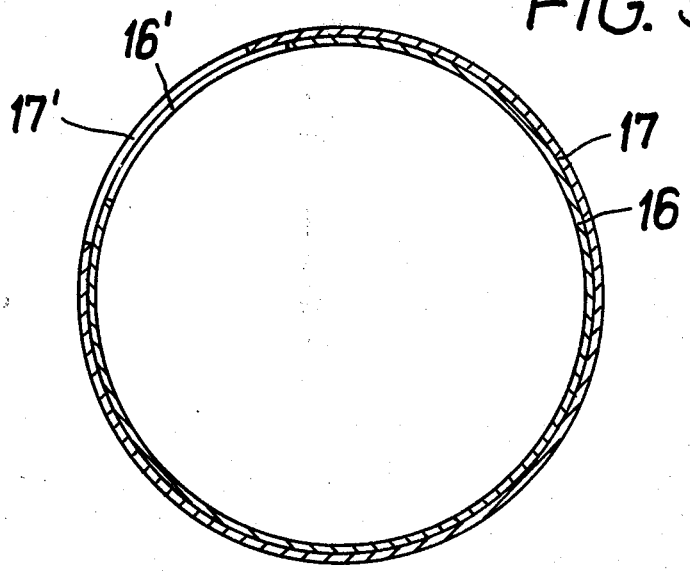
FIG. 3*b* is an axial, cross-sectional view of the multiple part fiber collecting ring of FIG. 3*a*.

The spinning unit shown in FIG. 3*a* has a fiber collecting ring 10 which is composed of two concentrically arranged tubular components 16 and 17. In the region of the frontal end face of the fiber collecting ring, each component is provided with a respective opening 16' or 17', shown in FIG. 3*b*, facing the spinning rotor. Rotation of the two components 16 and 17 relative to one another can change the effective size of the fiber discharge opening of the fiber collecting ring. It is further possible to change the position of the fiber discharge opening by rotating the fiber collecting ring or the components of the fiber collecting ring, respectively, with respect to housing 3, before fixing them relative to the housing. Dimensions of the collecting rings can be for example: diameter: 3 mm less than inner diameter D of rotor opening, length: 0.2 D, opening: 0.1 D extending around 10 to 50°.

The fiber guiding effect of the fiber collecting ring can be influenced by changing the position of its frontal end section with respect to the spinning rotor.

Figure 4:
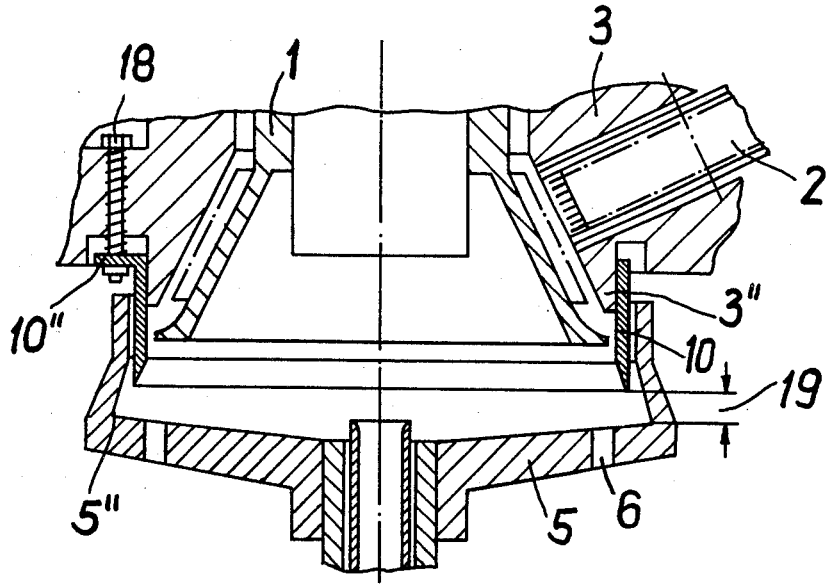
FIG. 4 is a view similar to that of FIG. 1 of an open-end spinning unit provided, according to another embodiment of the invention, with an axially displaceable fiber collecting ring.

In the simple embodiment shown in FIG. 4 which permits changing the axial position of the fiber collecting ring 10, this ring is connected via a flange piece 10'' with a setting screw 18 which fixes the axial position of ring 10 to housing 3. The threads of the setting screw 18 engage in a threaded bore of housing 3. By turning the screw 18, the fiber collecting ring 10 which is guided on cylindrical protrusion 3'' can be shifted in the axial direction over a certain range so that the distance 19 between the front edge of the ring and the fiber collecting trough 5'' will take on certain values, for example in dependence on the fiber material to be processed. The distance 19 can be for example 5% of the rotor diameter, if straight fibers are processed. For bulky fibers it can be more than 15%.

Figure 5:
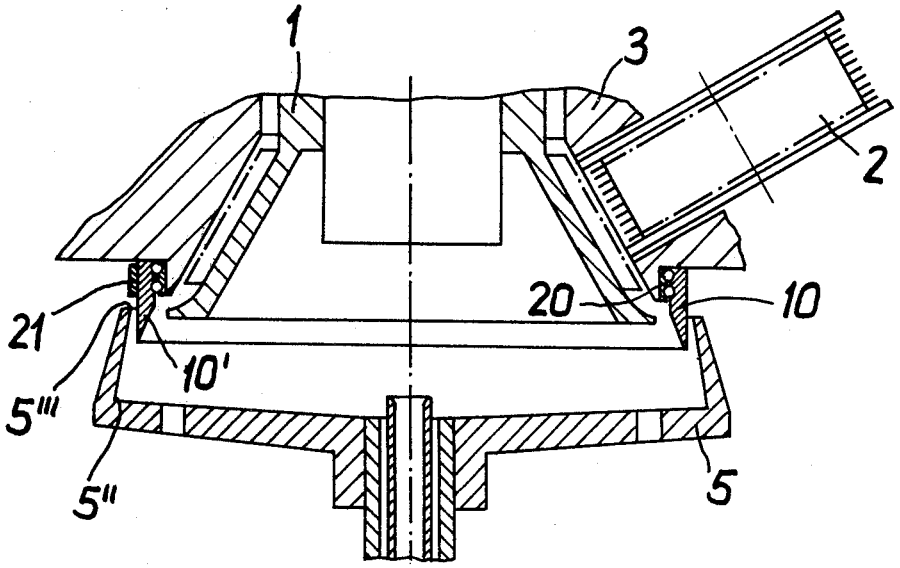
FIG. 5 is a view similar to that of FIG. 1 of an open-end spinning unit, provided, according to another embodiment of the invention, with a driven fiber collecting ring which is rotatably mounted on the break-up roller housing.

In the embodiment shown in FIG. 5 the fiber collecting ring 10 is rotatably supported at the housing 3 of the break-up roller through the intermediary of a bearing 20. Above the portion of the fiber collecting ring 10 which is covered by the spinning rotor 5, the fiber collecting ring is in connection, via a drive belt 21, with a drive means (not shown) which is able to rotate ring 10 to impart a peripheral speed to the inner surface 10' suitable for the spinning process. The rate of rotation of the fiber collecting ring 10, or its peripheral speed, respectively, in this case can be set independently of the speed of the break-up roller 1 or of the spinning rotor 5. If required, it can be greater than, for example, the peripheral speed of the spinning rotor in the area of the fiber collecting trough 5''.

Figure 6:
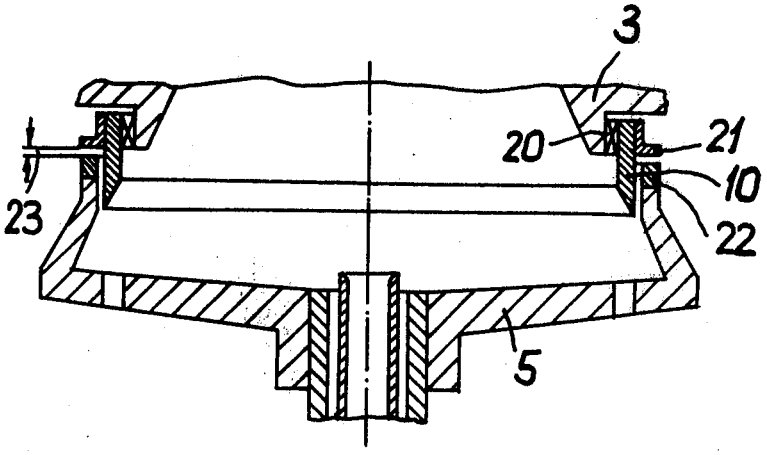
FIG. 6 is a view similar to that of FIG. 1, of an open-end spinning unit in which, according to a further embodiment of the invention, the rotatably mounted fiber collecting ring is driven by alternating magnetic effects originating from the spinning rotor.

There also exists the possibility of driving the fiber collecting ring 10, which is rotatably supported at housing 3, without contact, via the spinning rotor, as shown in FIG. 6. On the rear section of the fiber collecting ring shown in FIG. 6, an axially polarized multiple pole annular magnet 21 is fastened so as to be spaced opposite an annular surface of a body of electrically conductive material 22 which is fastened to the frontal face of the spinning rotor 5. Rotation of the spinning rotor 5 and the resulting relative movement of the axially oriented ring surface 22 with respect to the annular magnet 21 produces eddy currents in the electrically conductive material which result in a force which induces rotation of ring 10. Advisably the annular magnet 21 is connected with the fiber collecting ring 10 so that it is axially displaceable and thus it is possible to vary the axial distance 23 between the two parts which are in magnetic association with one another. By reducing the distance, the carrying effect exerted by the spinning rotor can be increased, i.e. the speed of the fiber collecting ring 10 can be increased.

The rate of rotation of the fiber collecting ring 10 will however always be less than the rate of rotation of the spinning rotor.

The advantage of this arrangement is that no special drive means is required for the fiber collecting ring 10 and no expensive accessories are required which could wear out.

It will be understood that the above description of the present invention is susceptible to various modifications, changes and adaptations, and the same are intended to be comprehended within the meaning and range of equivalents of the appended claims.

What is claimed is:

1. In an open-end spinning unit having a spinning rotor presenting an entrance opening, a break-up roller mounted for rotation coaxially with the spinning rotor and having a frontal end section at the end thereof directed toward the spinning rotor, and a housing enclosing at least part of the break-up roller, the improvement comprising a fiber collecting ring located between, and coaxial with, said spinning rotor and said break-up roller, and supported by said housing, said fiber collecting ring protruding axially, in the direction away from said spinning rotor, beyond said frontal end section of said break-up roller and, in the direction toward said spinning rotor, beyond said entrance opening of said spinning rotor, the inner surface of said ring facing said break-up roller and serving at least partially as a fiber guiding surface.

2. Spinning unit as defined in claim 1 further comprising means supporting said fiber collecting ring on said housing for axial displacement with respect to said housing.

3. Spinning unit as defined in claim 2 wherein the end portion of said fiber collecting ring which is directed toward said spinning rotor is provided with fiber discharge opening, and said supporting means permit said fiber collecting ring to be pivotally displaceable with respect to said housing.

4. Spinning unit as defined in claim 3 wherein said fiber collecting ring comprises a plurality of concentric tubular components which can be pivoted relative to one another.

5. Spinning unit as defined in claim 4 wherein said supporting means comprise a bearing device supporting said fiber collecting ring to be freely rotatable relative to said housing.

6. Spinning unit as defined in claim 5 wherein said fiber collecting ring is provided with an axially polarized, multiple pole annular magnet, and said rotor is provided with a body of electrically conductive material presenting an annular surface disposed opposite, and spaced from, said magnet.

7. Spinning unit as defined in claim 2 wherein said fiber collecting ring comprises a plurality of concentric tubular components which can be pivoted relative to one another.

8. Spinning unit as defined in claim 2 wherein said supporting means comprise a device supporting said fiber collecting ring to be freely rotatable relative to said housing.

9. Spinning unit as defined in claim 1 wherein said fiber collecting ring comprises a plurality of concentric tubular components which can be pivoted relative to one another.

10. Spinning unit as defined in claim 1 wherein said supporting means comprise a bearing device supporting said fiber collecting ring to be freely rotatable relative to said housing.

11. Spinning unit as defined in claim 1 wherein the end portion of said fiber collecting ring which is directed toward said spinning rotor is provided with a fiber discharge opening, and said ring is mounted to be pivotally displaceable with respect to said housing.

12. Spinning unit as defined in claim 1 wherein the portion of the inner surface of said fiber collecting ring at the end of said ring directed toward said spinning rotor, and in the region of said frontal end section of said break roller, tapers outwardly in the direction toward the spinning rotor.

13. Spinning unit as defined in claim 12 wherein the generatrices of the outwardly tapered portion of said inner surface are linear.

14. Spinning unit as defined in claim 12 wherein the generatrices of the outwardly tapered portion of said inner surface are curved.

15. Spinning unit as defined in claim 12 further comprising means supporting said fiber collecting ring on said housing for axial displacement with respect to said housing.

16. Spinning unit as defined in claim 12 wherein the end portion of said fiber collecting ring which is directed toward said spinning rotor is provided with a fiber discharge opening, and said supporting means permit said fiber collecting ring to be pivotally displaceable with respect to said housing.

17. Spinning unit as defined in claim 12 wherein said fiber collecting ring comprises a plurality of concentric tubular components which can be pivoted relative to one another.

18. Spinning unit as defined in claim 12 wherein said supporting means comprise a bearing device supporting said fiber collecting ring to be freely rotatable relative to said housing.

19. Spinning unit as defined in claim 12 wherein said fiber collecting ring is provided with an axially polarized, multiple pole annular magnet, and said rotor is provided with a body of electrically conductive material presenting an annular surface disposed opposite, and spaced from, said magnet.

* * * * *